US005329712A

United States Patent [19]

Keller

[11] Patent Number: 5,329,712

[45] Date of Patent: Jul. 19, 1994

[54] FRAME FOR THE DISPLAY OF PICTURES

[75] Inventor: Heinz Keller, Winterthur, Switzerland

[73] Assignee: Licinvest AG, Landquart, Switzerland

[21] Appl. No.: 855,632

[22] PCT Filed: Sep. 2, 1991

[86] PCT No.: PCT/EP91/01650

§ 371 Date: May 5, 1992

§ 102(e) Date: May 5, 1992

[87] PCT Pub. No.: WO92/03956

PCT Pub. Date: Mar. 19, 1992

[30] Foreign Application Priority Data

Sep. 9, 1990 [DE] Fed. Rep. of Germany ..... 4028645

[51] Int. Cl.[5] ..... G09K 1/12

[52] U.S. Cl. ..... 40/152.1; 40/513; 248/558

[58] Field of Search ..... 40/152, 152.1, 156, 40/160, 513; 248/299, 472, 455, 456, 558

[56] References Cited

U.S. PATENT DOCUMENTS

| | | | |
|---|---|---|---|
| 1,001,403 | 8/1911 | Hipwell | 40/152.1 |
| 1,232,095 | 7/1917 | Sass | 40/152.1 |
| 2,456,720 | 12/1948 | Miles | 40/152.1 |
| 3,186,117 | 6/1965 | Detje | 40/156 X |
| 3,343,777 | 9/1967 | Becker | 248/455 |
| 4,376,348 | 3/1983 | Ackeret | 40/513 |
| 4,413,435 | 11/1983 | Baur | 40/155 |
| 4,798,015 | 1/1989 | Ackeret | 40/152.1 |
| 5,068,987 | 12/1991 | Tontavelli | 40/152.1 |

FOREIGN PATENT DOCUMENTS

| | | | |
|---|---|---|---|
| 150994 | 1/1903 | Fed. Rep. of Germany . | |
| 811369 | 8/1951 | Fed. Rep. of Germany | 40/152.1 |
| 23097 | 9/1989 | United Kingdom | 40/152.1 |

*Primary Examiner*—Brian K. Green
*Attorney, Agent, or Firm*—Robert R. Jackson

[57] ABSTRACT

A picture frame has a plastic rear wall wherein a bearing member is mounted so as to be pivotable about an axis orthogonal to the rear wall between a first and a second end position spaced by 90°. A prop is hinged to the bearing member so as to be unfoldable from a recess of the rear wall into a first spread-apart position when the bearing member assumes the first end position and into a second spread-apart position when the bearing member is in its other end position. In either spread-apart position, the prop defines a different angle with the rear wall, said angles being determined by stops on the rear wall cooperating with stops on the prop.

8 Claims, 9 Drawing Sheets

200
244
218
212
214
204
216
X
A
208
Z
206
220
272
202

FRAME FOR THE DISPLAY OF PICTURES

BACKGROUND OF THE INVENTION

The present invention relates to a frame for the display of pictures. Such frame may be an ordinary picture frame but the invention is preferably used in connection with a so-called sheet exchanger or picture exchanger as disclosed e.g. in U.S. Pat. No. 4,879,825. Briefly, such an exchanger comprises a housing having a display window in which a picture or sheet of a stack of sheets is exhibited. A slider may be reciprocated relative to the housing in a direction parallel to the window and activates an exchange mechanism by which the stack is cyclically rearranged. Such an apparatus stores a relatively great number of pictures, in particular photographic prints, but may also be used as a hanging frame or as a display stand. In the latter case, the housing is to be provided with a stand or prop.

A sheet exchanger having a prop is disclosed in U.S. Pat. No. 4,798,015. The prop extends under an angle almost diagonally with respect to the outer edges of the substantially rectangular housing and is connected to the housing by means of a hinge about which the prop may be pivoted into its operative position defined by stop lock means. The term "stop lock" as used herein defines a positive arresting of the prop when unfolded from the frame. The design is such that the frame defines the same angle with a table or like support when it is in upright and when it is in sidewise position. When the prop is not used it may be folded back into a complementary housing recess. A complementary recess for accomodation of a triangular frame prop is also disclosed in Swiss patent 456 875. Another sheet exchanger having a prop which may be pivoted relative to the housing about two axes is disclosed in U.S. Pat. No. 4,376,348.

U.S. Pat. No. 3,343,777 discloses a display stand provided with a prop. The prop is hinged to a support member which is pivotably mounted on the rear side of a frame member. The pivotable support member may be turned into any position, and the angle between the frame member and the prop may be arbitrarily adjusted to the convenience of the user.

Another frame provided with a prop is disclosed in British patent 1,073,651. The prop is integrally molded from plastics material. It comprises a hub portion to be mounted on the frame back and a prop portion connected to the hub portion by means of a hinge formed by a notch between hub and prop. The notch is triangular in cross section so as to define a stop which limits the angle between frame and prop. As the frame is rectangular but not square, the angle between the frame and a supporting surface is different for up-right and sidewise position when the prop is positioned by the stop.

German patent 150994 discloses a frame having a prop system basically similar to that of British patent 1,073,651.

SUMMARY OF THE INVENTION

It is the object of the present invention to provide a frame for display of at least one picture provided with a prop, the assembly of frame and prop being rigid and easy to handle so that in upright and sidewise position the proper angle between frame and supporting table or the like is provided by the appropriate angle between frame and prop.

Under a first aspect, the invention provides a frame for display of at least one picture, including:

a frame body comprising a rear wall made of plastics material, said frame body having a first pair of relatively long parallel edges and a second pair of relatively short parallel edges, prop means for supporting the frame as a stand, said prop means comprising a bearing member mounted on said frame body rear wall and pivotable relative thereto through 90° between a first and a second end position about an axis which is perpendicular to said rear wall, said prop means further comprising a leg swingably mounted on said bearing element to support in a spread-apart position said frame body in either of an upright and sidewise position on one of said shorter and longer edges, respectively, said axis being spaced by different distances from said one edges, and said frame body having a stop lock for each of said end positions such that said frame body defines with a supporting plane substantially the same angle in said up right and sidewise positions.

Under a second aspect, the invention provides a frame for display of at least one picture, including:

a frame body comprising a rear wall made of plastics material, and prop means for supporting the frame as a stand, said prop means comprising a bearing member mounted on said frame body rear wall and pivotable relative thereto through a 90° range between a first and a second end position about an axis which is perpendicular to said rear wall, said prop means further comprising a leg swingably hinged to said bearing element, said bearing element being connected to said rear wall by means of a bayonet catch which can be engaged in a predetermined angular position out of said 90° pivot range whereafter said bearing element is turned into said 90° range, and stop means for preventing returning of said bearing element off said 90° range into a catch disengagement position.

Under a third aspect, the invention provides a frame for display of at least one picture, including:

a frame body comprising a rear wall made of plastics material, said frame body having a first pair of relatively long parallel edges and a second pair of relatively short parallel edges, a leg for supporting said frame body as a stand, said leg being mounted on said rear wall pivotably through 90° between a first and a second end position about an axis which is perpendicular to said rear wall, said leg being unfoldable from said rear wall into a first angular position in said first end position and into a second angular position in said second end position, and guide means on said rear wall for cooperating with said leg so as to bring the leg from said first angular position into said second angular position upon the leg being pivoted from said first end position into said second end position.

Under a fourth aspect, the invention provides a frame for display of at least one picture, including:

a frame body comprising a rear wall made of plastics material, said frame body having a first pair of relatively long parallel edges and a second pair of relatively short parallel edges, a leg unfoldably mounted on said frame body rear wall and pivotable relative thereto through at least 90° about an axis which is perpendicular to said rear wall, said rear wall having a recess into which said leg may be folded when not in use, and a slider reciprocable relative to said frame body in a direction parallel to said shorter edges between an inner end position and an outer end position, said slider having a grip portion which in said inner end position is flush with one of said longer edges, and said rear wall recess being located between said grip portion and the other of said longer edges.

A preferred embodiment of the invention is illustrated in the accompanying drawings and will be explained in detail hereunder.

BRIEF DESCRIPTION OF THE DRAWINGS

FIGS. 8 and 9 are section views to show the two operational positions of the prop.

DETAILED DESCRIPTION OF THE PREFERRED EMBODIMENTS

Figure 1:
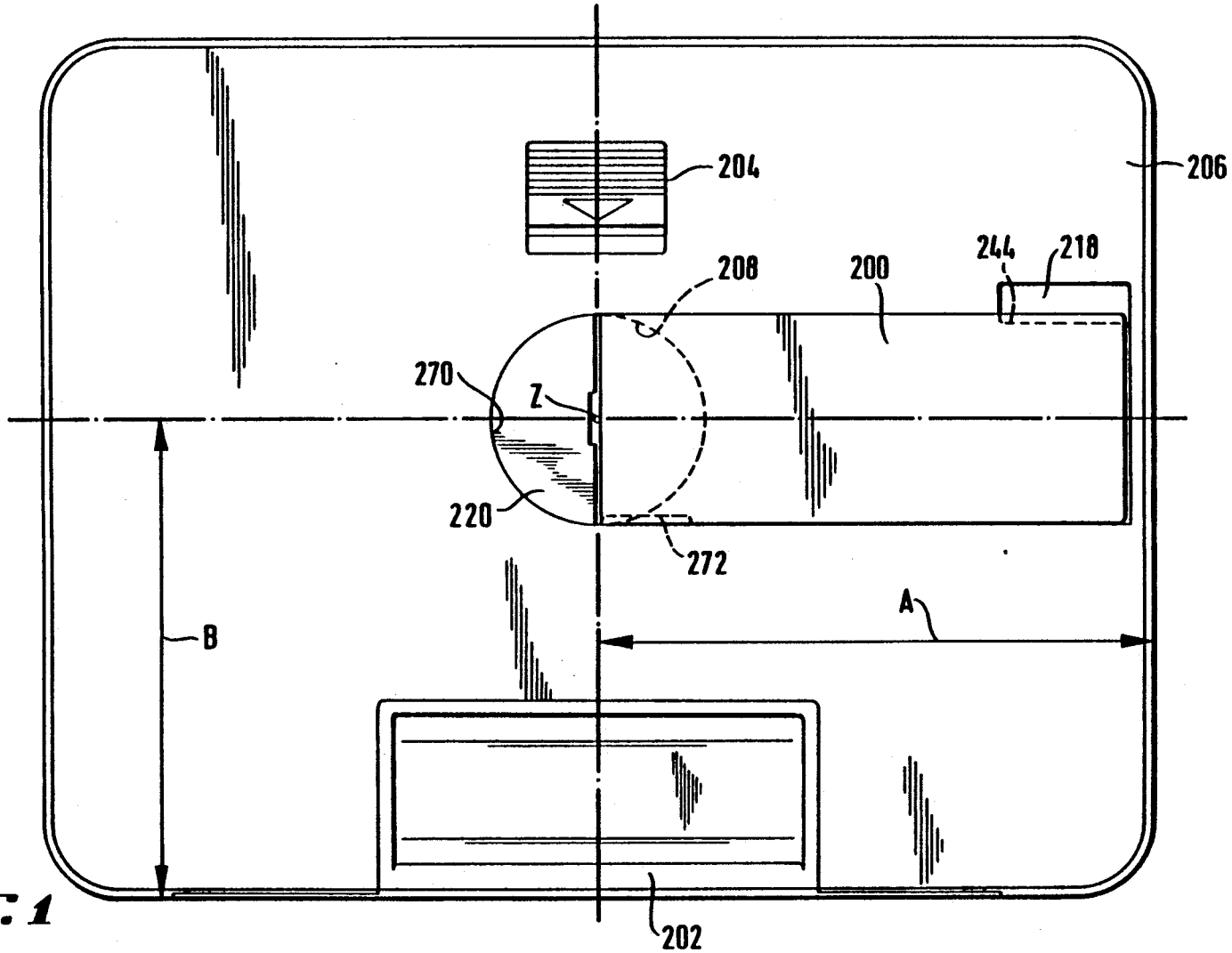
FIG. 1 shows a rear view of a sheet exchanger including a prop system in accordance with the invention.

The embodiment illustrated in the drawing is a sheet exchanger as defined above. It will be understood, however, that the invention is likewise applicable to an ordinary picture or even mirror frame, and what is designated hereinafter as the "housing bottom" of the sheet exchanger would then be the rear wall of the frame.

FIG. 1 is a rear view with the prop being folded unto the rear wall of the frame or, more precisely, the housing bottom of the sheet exchanger. The prop is designated 200 in its entirety. The grip portion 202 of the slider and a key 204 which, when actuated, permits removal of a sheet stack from the slider are preferred elements for the exchange function.

Figure 2:
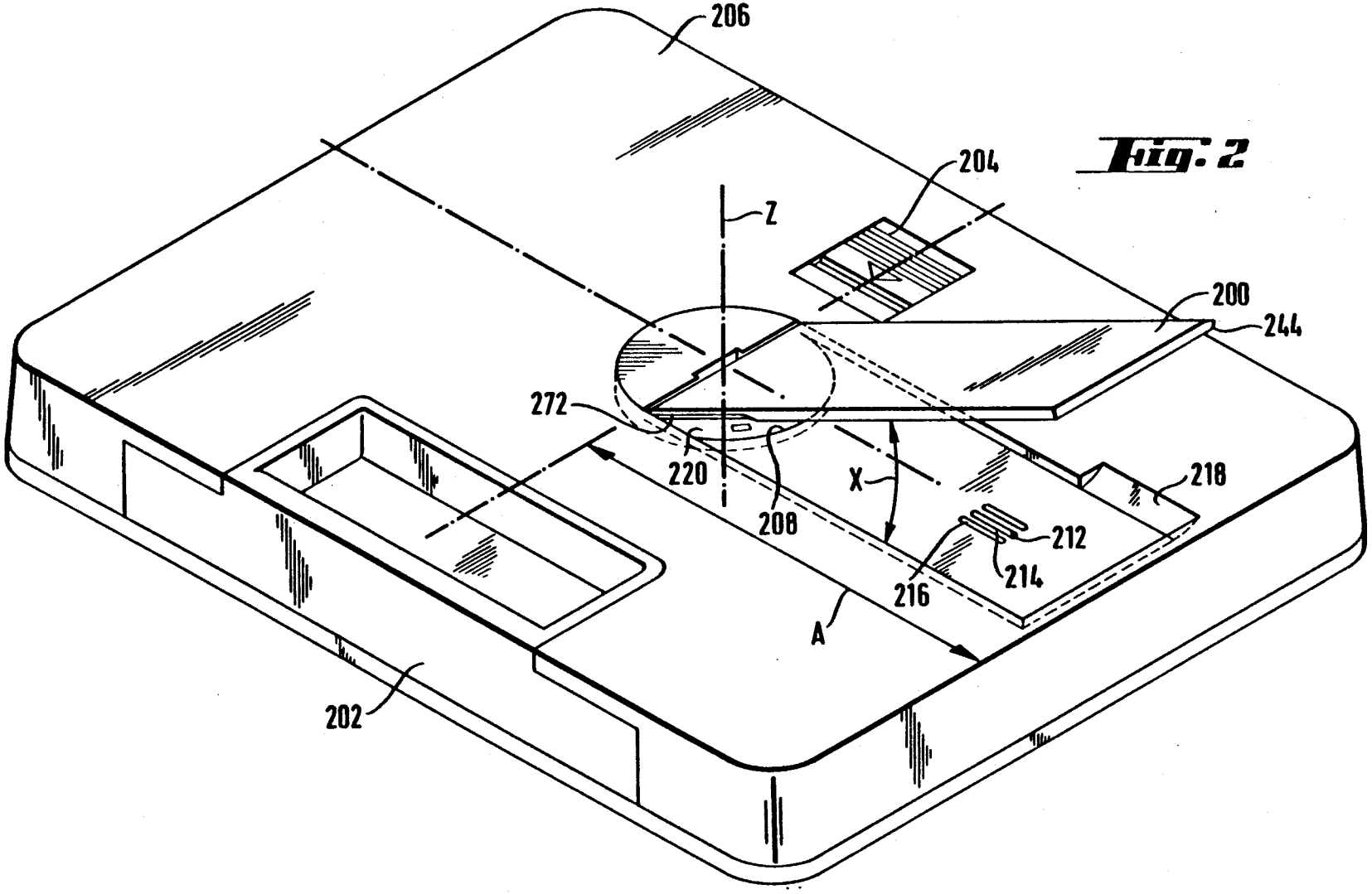
FIGS. 2 and 3 show respectively the unfolded prop in its pivotal end positions.
Figure 3:
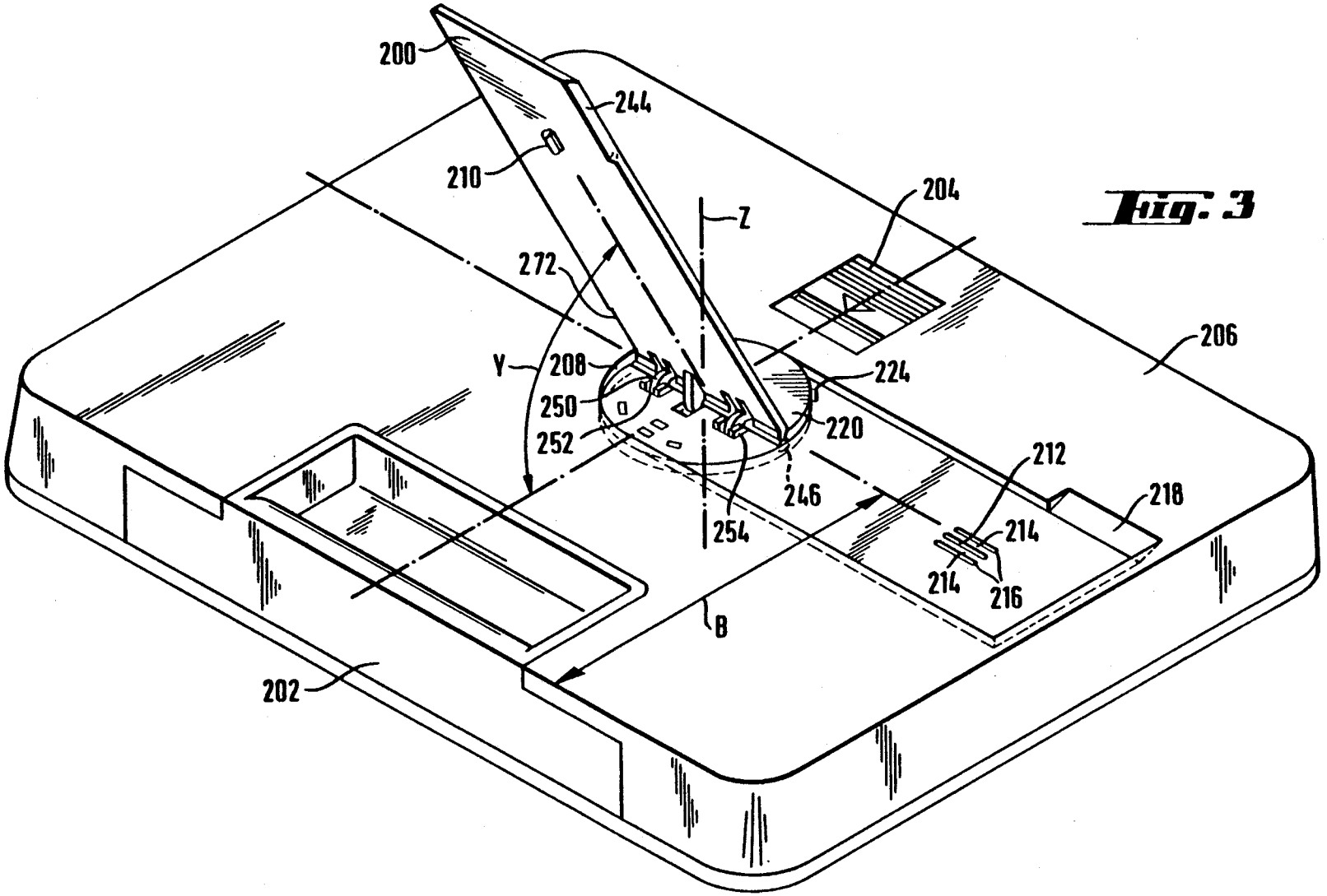

Because of the presence of key 204, the pivot axis of the pivotable prop is at a position where the distance "A" between pivot axis "Z" and the allocated end edge of the housing or frame is longer than the distance "B" between axis "Z" and that housing edge which extends perpendicular to the first-mentioned edge. The invention provides that the angular position of the frame or housing be substantially the same when placed in upright or sidewise position on a table or other support, and to achieve this, the unfold angle of the prop is different in these two placing positions. These angles are marked "X" and "Y", respectively, in FIGS. 2 and 3.

The invention provides that upon pivoting the prop about axis "Z" the proper angle "X" and "Y", respectively, is automatically achieved.

The design is such that assembly of the prop can be effected by a robot or the like.

Figure 4:
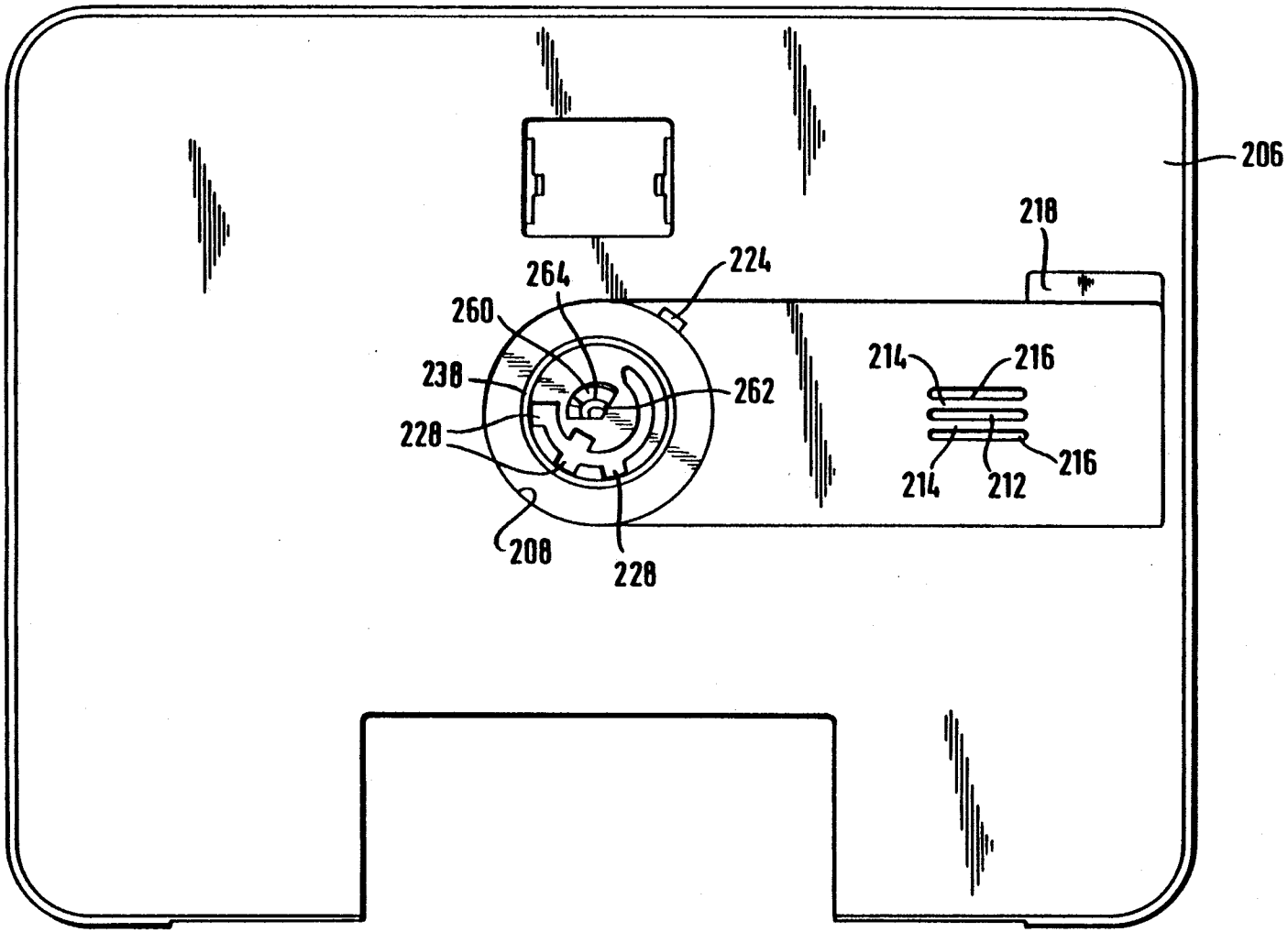
FIG. 4 shows the housing bottom prior to assembly of the prop.

FIG. 4 shows the bottom shell 206 of the housing from its outside. A recess 208 is seen in the pivot center which will be explained in more detail later and which receives the bearing element or hub of the prop. When the leg of the prop is folded unto shell 206, leg button 210 engages into a slot 212, delimited by webs 214 which may resiliently yield because of the parallel outer slots 216. A finger recess 218 facilitates unfolding of the leg.

Figure 5:
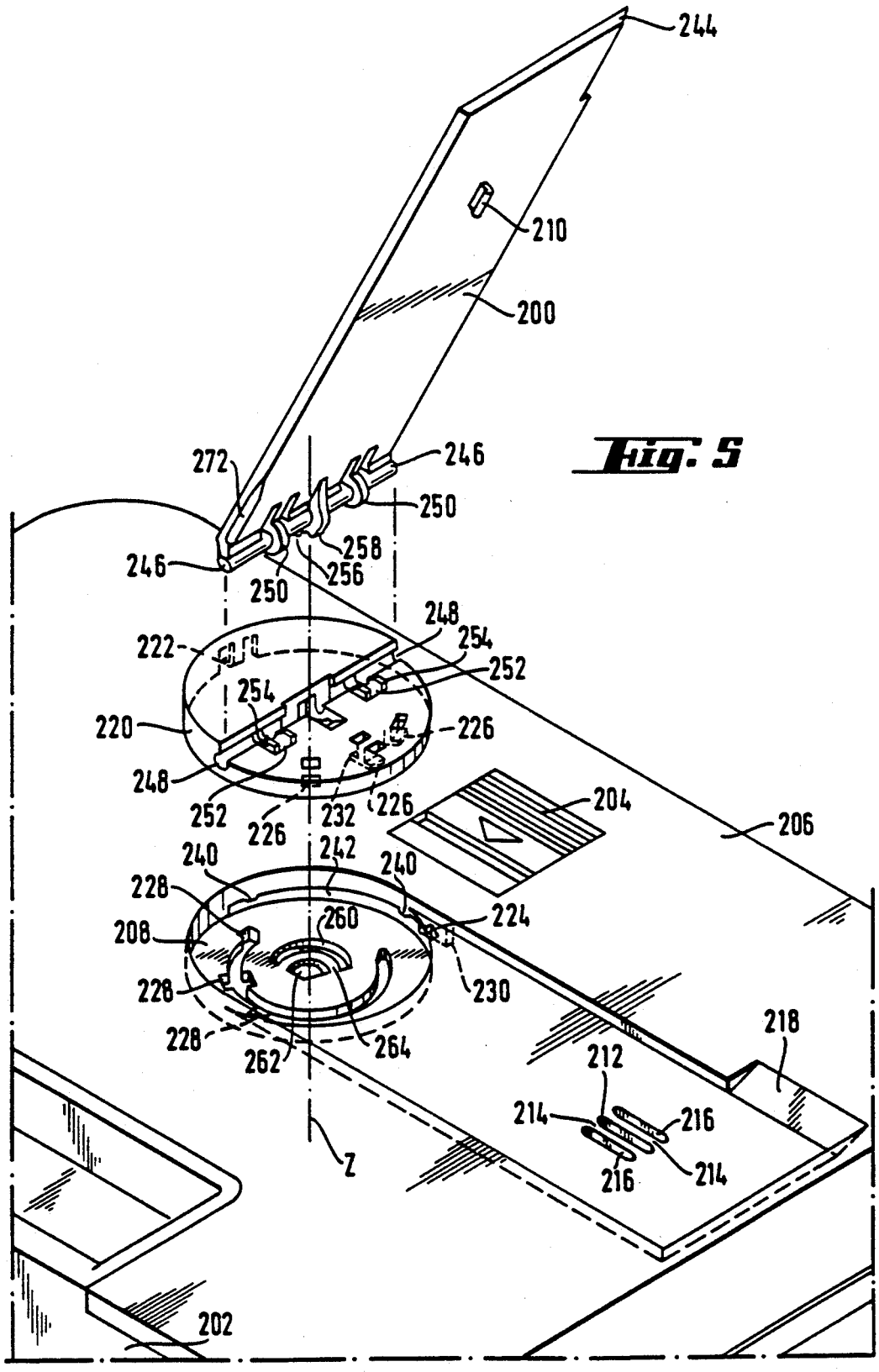
FIG. 5 is an exploded view of the entire prop system.
Figure 6:
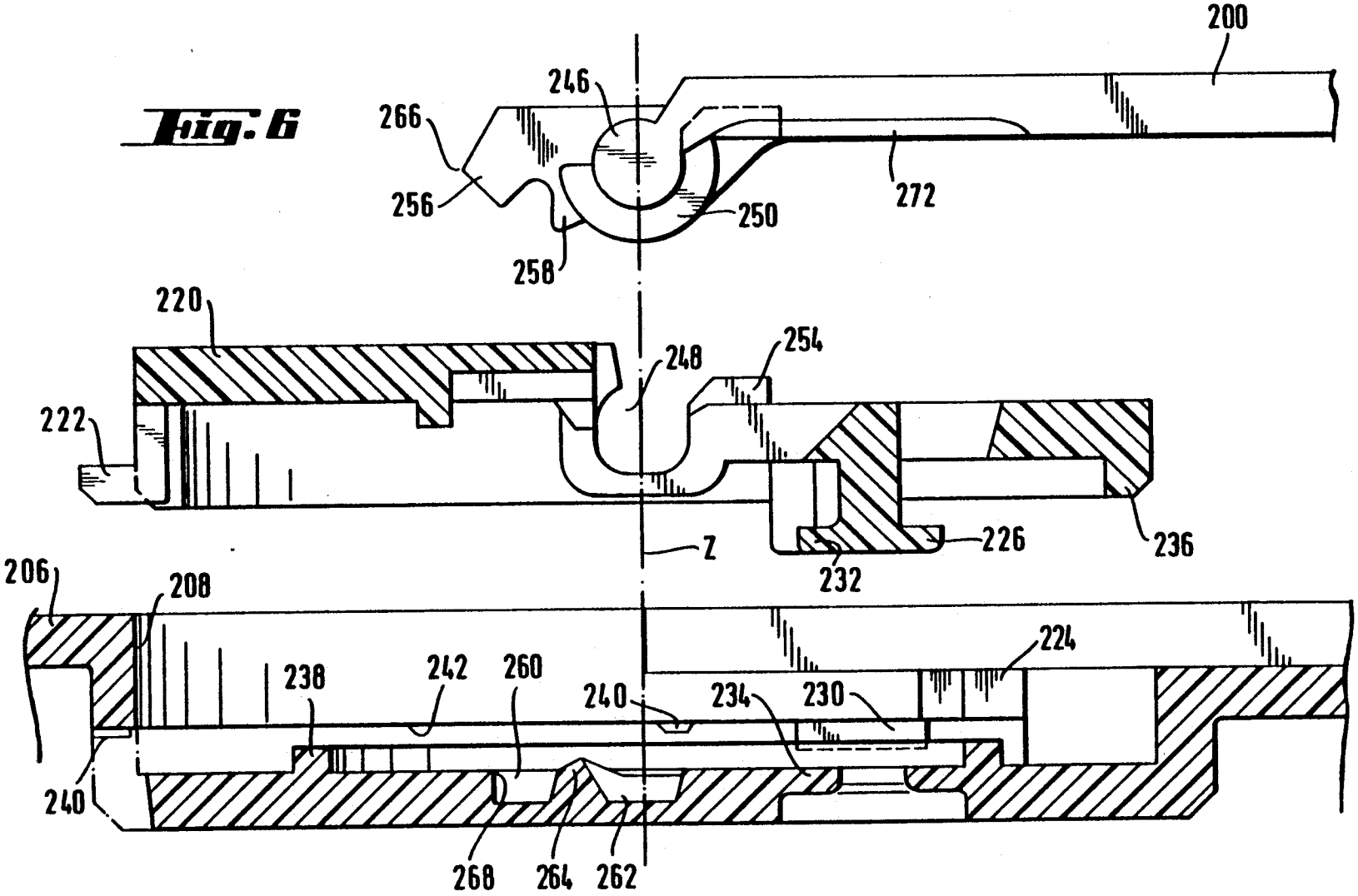
FIG. 6 is an exploded side view of details of the prop system in enlarged scale.
Figure 7:
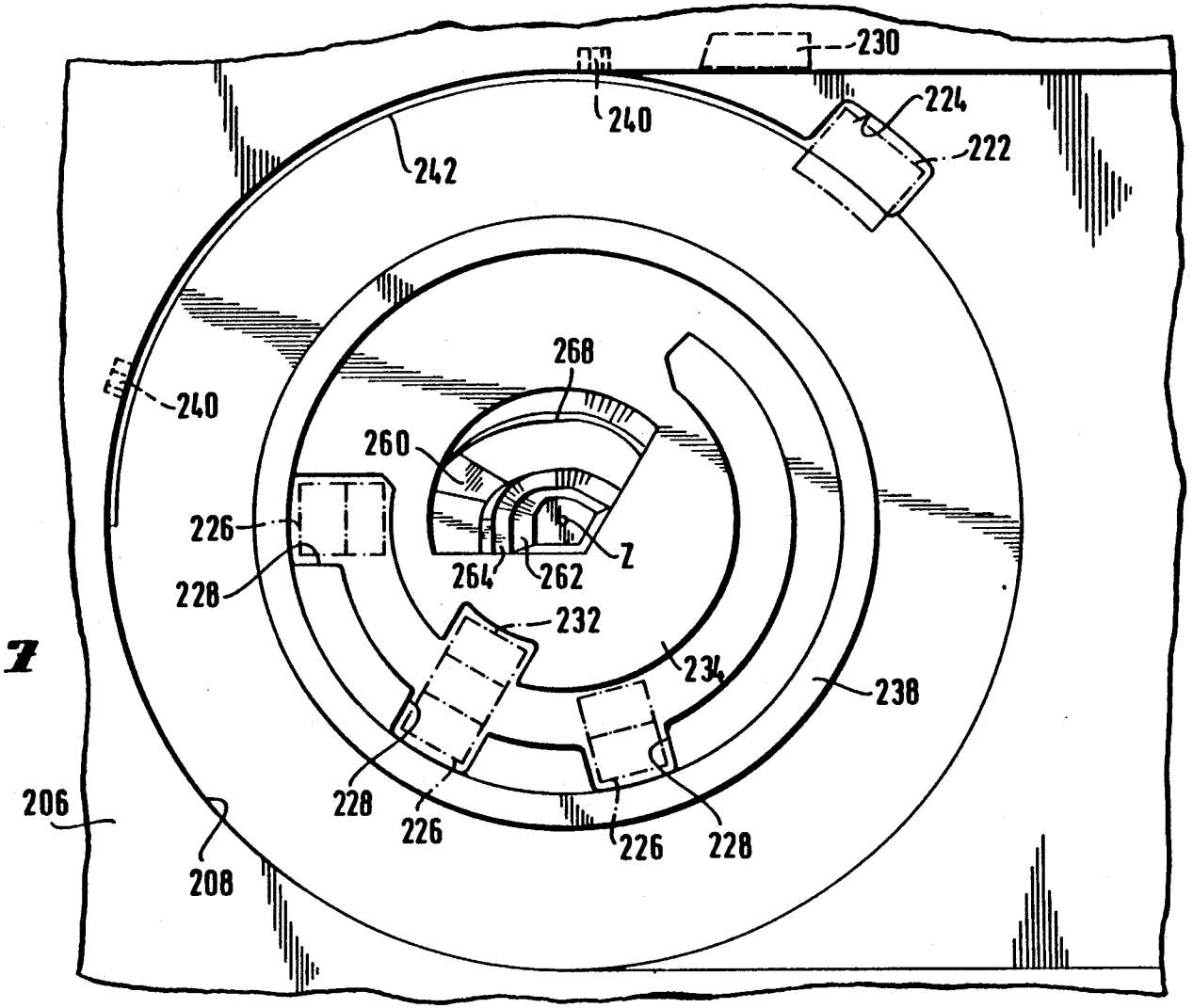
FIG. 7 illustrates in enlarged scale a plan view of the bearing element.

FIGS. 5 and 6 show respectively an exploded isometric view and an exploded section view of the individual components and how they are assembled.

The hub 220 which forms the bearing element is mounted in housing bottom 206 by means of a bayonet catch, and this is possible in an angular position of the hub relative to the housing bottom which the hub, once assembled, cannot assume any more because its return into the assembly position where disengagement would be possible is prevented by means of a stop.

For this purpose, hub 220 has a first, outer claw 222 which passes through an aperture 224 of the bottom, and three inner claws which pass through apertures 228 of the bottom. The inner claws 226 have different angular spacings so that, upon pivoting of the hub, always at least two of the claws remain in bayonet engagement while the third passes across the respective aperture.

The outer claw has two additional functions. At first, once the hub is inserted and pivoted through about 30°, it passes a stop extension 230 where claw 222 is elastically flexed inwards and, once having passed stop extension 230, returns into its unflexed position. Stop extension 230 prevents re-pivoting of hub 220 into its insertion position where it could be disengaged. Further, stop extension 230 defines one of the end positions of hub 220 in which the frame stands on its longer edge.

The central one of the inner claws is provided with a hook 232 pointing toward the hub axis. Hook 232 engages beneath portion 234 of the housing bottom for stabilizing purposes. The circumferential shoulder 236 of the hub supports and positions the hub in recess 208. A protruding rib 238 on the housing bottom stiffens the relatively thinwalled portions and is not shown in FIG. 5 in order to simplify the illustration.

Cams 240 integrally molded with the housing bottom define end positions of the prop, and claw 222 yields inwards when hitting them. The recess 242 accomodating claw 222 extends over one third of the circumference: 90° for the pivoting of the hub during use plus 30° for assembly purposes as mentioned above.

The hub carries the very prop or the leg 200. Adjacent its free end there is a chamfer 244 opposite recess 218 for facilitating unfolding.

Adjacent its hinged opposite end, leg 200 has hinge means, securing means to prevent disassembly, stop lock means for the unfolded positions.

The hinge and securing means are not described here in very detail because they are known from U.S. Pat. No. 4,798,015 the disclosure of which is incorporated herein by reference. Briefly, they comprise bearing pins 246 snap-fitted into bearing shell 248 of the hub and projections 250 cooperating with apertures 252 and ribs 254 on the hub. The leg carries beyond the hinge a first cam follower 256 and, preferably, a second cam follower 258. The bottom shell of the housing has cam guides, one for each cam follower. The cooperation between the cam followers and the cam guides 260 and 262 is best seen in FIGS. 8 and 9.

Figure 8:
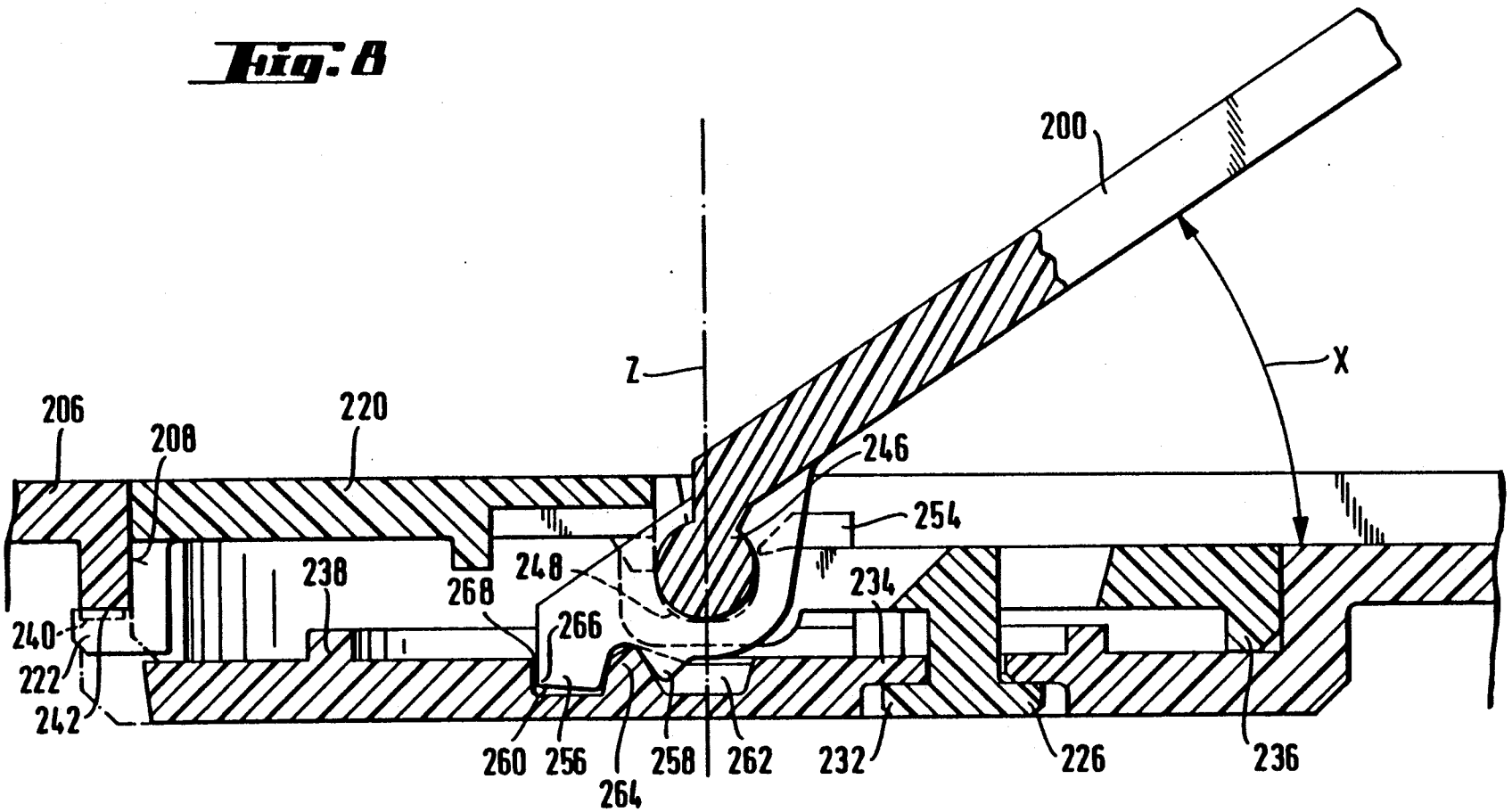
Figure 4:
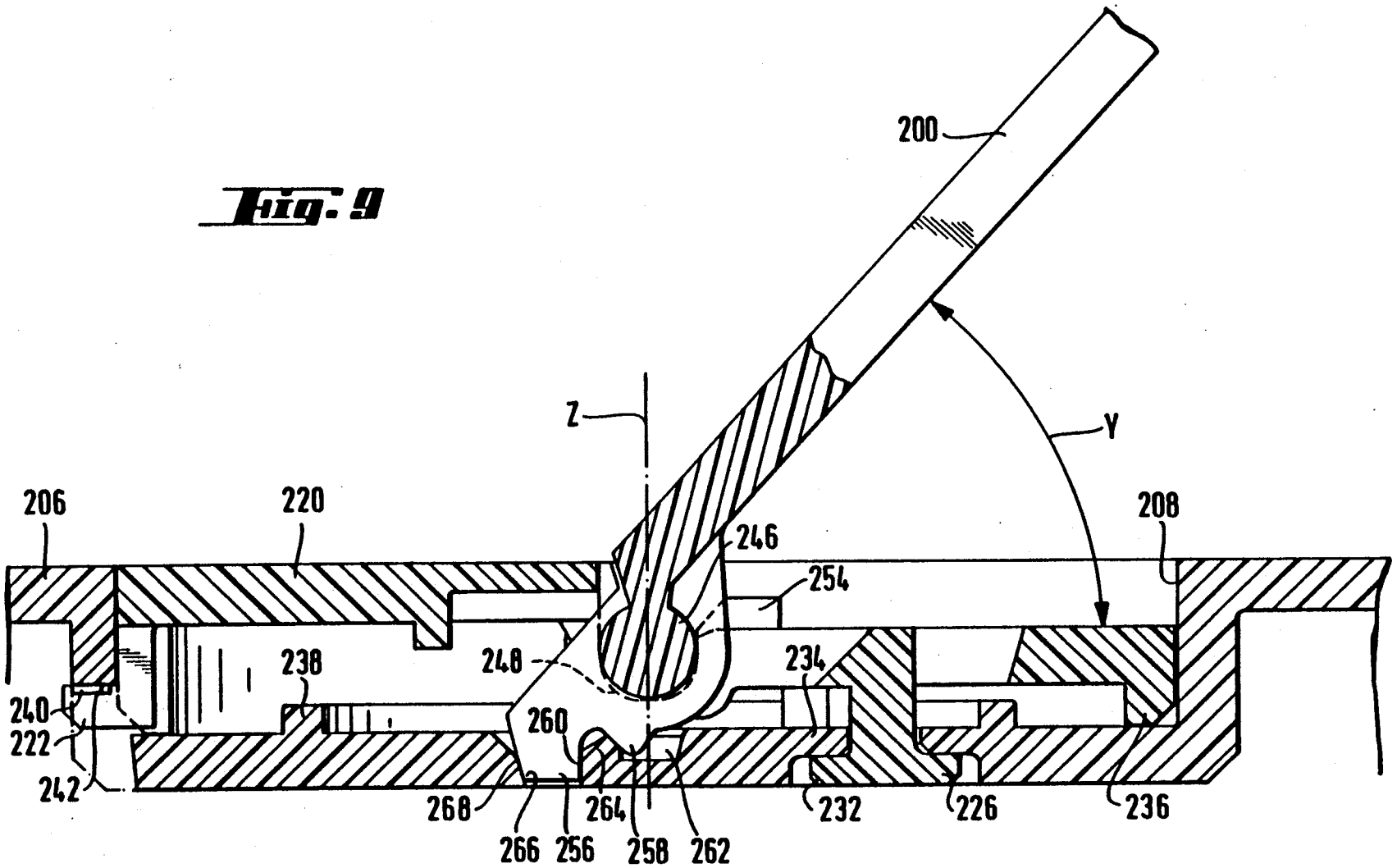

FIG. 8 shows the leg position under angle "X". Cam follower 256 abuts at the less deep range of cam guide 260 while cam follower 258 finds support on the inner side of guide contour 264. When the leg is unfolded, edge 266 of cam follower 256 overcomes the counter edge 268 of the cam guide under elastic deformation and assumes then an arrested position so as to stabilize the unfolded position of the leg. This stabilization remains upon pivoting movement of the hub about axis "Z" through 90° as may be seen in FIG. 9. Cam follower 256 is guided along cam guide 260 which steadily becomes deeper and steadily approaches axis "Z" into the end position illustrated in FIG. 9. Similar considerations apply with respect to the second cam follower and its cam guide 262.

If one tries to fold leg 200 towards the rear wall of the housing when the hub is in the position of FIG. 9 there is a risk that its edge hits the housing bottom edge 270 surrounding recess 208 which could result in damage of either component. In order to avoid this risk, leg 200 has a chamfer 272 which slips along said housing edge.

An expert skilled in the art of injection molding will realize that the components of the described embodiment may be produced in this technique with the molds being of relatively simple design, and that the design is particularly suited for robot assembling.

Also, it will be noted that after assembly the exposed face of the hub is flush with the surrounding face of the housing bottom, and that the leg also is flush therewith when folded into the housing recess.

I claim:

1. A frame for display of at least one picture, including:

a frame body comprising a rear wall made of plastic material, said frame body having a first pair of relatively long parallel edges and a second pair of relatively short parallel edges, prop means for supporting the frame as a stand, said prop means comprising a bearing member mounted on said frame body rear wall and pivotable relative thereto through a 90° range between a first and a second end position about an axis which is perpendicular to said rear wall, said prop means further comprising a leg swingably mounted on said bearing member to support in a spread-apart position said frame body in either of an upright and sidewise position on one of said short and long edges, respectively, said axis being spaced by a different distance from said one short edge than from said one long edge, and said frame body having a stop lock for each of said end positions, each of said stop locks engaging said leg in order to fix said leg in an associated spread-apart position from said frame body such that said frame body when placed on a support plane defines therewith substantially equal angles in said upright and sidewise positions.

2. The frame of claim 1 wherein said bearing member is connected to said rear wall by means of a bayonet catch which can be engaged when said bearing member is in a predetermined angular position out of said 90° range and, after said bayonet catch is thus engaged, said bearing member is turned into said 90° range, and wherein said frame further includes:

stop means for preventing returning of said bearing member off said 90° range into a catch disengagement position.

3. The frame of claim 1 or claim 2 wherein said bearing member has an outer surface substantially flush with an outer surface of said rear wall and has a recess adapted to accommodate a portion of said leg, and wherein said rear wall has a recess to accommodate a remaining portion of said leg whereby said leg when folded unto said rear wall is substantially flush with an outer surface of said rear wall.

4. The frame of claim 1 further including:

guide means on said rear wall for cooperating with said leg so as to bring the leg from the spread-apart position associated with the stop lock for the first end position into the spread-apart position associated with the stop lock for the second end position upon the bearing member being pivoted from said first end position into said second end position.

5. The frame of claim 1 wherein said rear wall has a recess into which said leg may be folded when not in use, and wherein said frame further includes:

a slider which is reciprocable relative to said frame body in a direction parallel to said short edges between an inner end position and an outer end position, said slider having a grip portion which in said inner end position is flush with one of said long edges, and said rear wall recess being located between said grip portion and the other of said long edges.

6. The frame of claim 5 wherein said recess has a contour complementary to that of said leg.

7. The frame of claim 1 or claim 2 or claim 4 or claim 5 wherein said leg has two straight parallel longitudinal edges.

8. The frame of claim 5 wherein said leg has two parallel straight longitudinal edges which extend parallel to said long edges of said frame body when said leg is folded into said rear wall recess.

* * * * *